United States Patent [19]

Bennett

[11] Patent Number: 4,886,106

[45] Date of Patent: Dec. 12, 1989

[54] DIE CAST MACHINE WITH A TURRET

[75] Inventor: Charles H. Bennett, Mount Gilead, Ohio

[73] Assignee: HPM Corporation, Mount Gilead, Ohio

[21] Appl. No.: 170,122

[22] Filed: Mar. 15, 1988

Related U.S. Application Data

[63] Continuation of Ser. No. 939,632, Dec. 9, 1986, abandoned.

[51] Int. Cl.[4] ..... B22D 19/00

[52] U.S. Cl. ..... 164/70.1; 164/109; 164/131; 164/264; 164/332; 164/334; 164/DIG. 10; 164/98

[58] Field of Search ..... 164/98, 109, 130, 131, 164/322, 327, 332, 342, DIG. 10, 344, 262, 264, 265, 70.1

[56] References Cited

U.S. PATENT DOCUMENTS

| | | | |
|---|---|---|---|
| 2,807,844 | 5/1953 | Hemphill | 164/312 |
| 3,826,302 | 7/1974 | Wunder | 164/312 |
| 4,064,928 | 12/1977 | Wunder | 164/109 |
| 4,148,353 | 4/1979 | Quere | 164/341 |
| 4,362,205 | 12/1982 | Cole et al. | 164/109 |
| 4,399,859 | 8/1983 | Marcil | 164/342 |

FOREIGN PATENT DOCUMENTS

| | | |
|---|---|---|
| 0036687 | 9/1981 | European Pat. Off. . |
| 197882 | 8/1967 | U.S.S.R. . |

*Primary Examiner*—Richard K. Seidel

*Attorney, Agent, or Firm*—Jeffers, Hoffman & Niewyk

[57] ABSTRACT

A die casting apparatus for forming rotors for electric motors. The apparatus includes a frame having at least two opposed stationary pressure plates and a rotating turret rotatively mounted betewen these stationary plates. The turret includes three apertures at three equally spaced locations around the turret. Tooling is arranged at each of the respective locations for forming a rotor. Compensating and casting tooling is located at a first station, pin pressing and trimming tooling is located at the second station and unloading and loading tooling is located at the third station. The operations at the respective stations proceed simultaneously. The operations are selected so that the combined operations of each of the stations will take approximately equal amounts of time.

17 Claims, 9 Drawing Sheets

DIE CAST MACHINE WITH A TURRET

This is a continuation of application Ser. No. 939,632, filed Dec. 9, 1986, now abandoned.

BACKGROUND OF THE INVENTION

This invention relates to automatic die casting machines and, in particular, to horizontal rotary die casting machines which are used to cast rotors for electric motors or the like.

More particularly, this invention relates to an improved die cast machine for automatically casting rotors in a minimum amount of time. The machine is arranged to simultaneously perform a plurality of operations or functions at three stations. The functions or operations to be performed at each of the stations are arranged to optimize the operating speed of the machine.

Conventional die casting machines generally include stationary front and back plates and a movable or traveling plate which is reciprocably mounted between the two stationary plates. The relative positions of the stationary plates are maintained by a plurality of tie bars which extend between the two stationary plates. Die halves are fastened to the front plate and the traveling plate, respectively, and the traveling plate is extended and retracted to respectively close and open the die. After the die is closed, molten metal is injected into the die to form a die cast part. After a part is thus formed, the die is opened by retracting the traveling die and, after the traveling plate has moved a predetermined distance, bumper pins which are slidably mounted in apertures located both in the die and the traveling plate engage a bumper plate which is located behind the traveling plate. These bumper pins engage and eject the die cast part from the portion of the die which is attached to the traveling plate. After the die cast part is removed from the die casting machine, the excess metal, generally referred to as a sprue or runner system, is removed from the die cast part in a separate pressing machine called a trim press.

Other prior art die casting machines incorporate the trimming operation in the die casting machine. In this type of machine, an indexing apparatus rotates the die cast part between a casting station and a trimming station in the die casting machine. Further, in die casting conventional parts, the cast part is usually attached to the indexing mechanism by the sprue which is formed in die casting the part. The die cast part is then rotated to the trimming station where the sprue is removed.

One application for die casting machines involves casting a rotor of an electrical motor. In this type of application, the body of the motor comprises a stack of circular plates or laminations which are secured together by a temporary skew pin inserted through aligned central openings in the laminations. The die casting machine is employed for casting the connector bars and end rings of the rotor assembly. An indexing apparatus first picks up the rotor body at a loading station and then moves it to a casting station where the connector bars and end rings are formed. The rotor is then carried through a cooling station, and the temporary skew pins are ejected from the cast rotor. Finally, the rotor is removed from the machine. At some point, the sprue or runner system is removed from the completed rotor and returned to a waste container for reuse.

In most prior art die casting machines, molten material, usually zinc, aluminum, or magnesium, is injected into the die in one of two ways. In one method, the molten material is conveyed to the part periphery and is injected into the side of the die cavity, thereby leaving a runner attached to the side of the cast part. This is called "side gate casting." In another method, the molten metal is injected into the ends of the die cavity through inwardly tapered cone-shaped openings in the die plate. Such openings have a small diameter on the side of the die plate adjacent the interior of the die cavity. This method is called "pin-point gating" because the runner system is attached to the molded part only by means of narrow necks or pin points of molded material which may be broken away to remove the runner system from the cast part.

In yet another prior art die casting machine, a six station indexing mechanism is mounted between two stationary plates for moving a part in rotary fashion through a plurality of spaced stations. One operation is performed at each station. A toggle linkage mechanism moves a traveling plate alternately forward and away from the indexing mechanism. A disadvantage of this prior art automatic indexed multistation die casting machine is that the time required for casting a rotor is longer than desired. By arranging the machine so that six stations are provided, the factor which limits the speed of the machine is the longest time required for completing one of the six operations. Thus this arrangement limits the indexing speed of the machine to the completion of the operation which requires the greatest amount of time. Furthermore, in this prior art machine, a separate ejector mechanism is provided, thus adding further to the length of time required for casting and ejecting a rotor and further adding to the complexity of the machine.

Additionally, since in prior art die casting machines a relatively heavy tooling section, such as the traveling plate, is moved over a relatively large distance for closing the die prior to casting a part, the long stroke for the traveling plate requires additional time for completion of one cycle of the machine, thereby adversely affecting the productivity of the machine.

Still further, the prior art die casting machines do not provide full compensation to account for various rotor stack heights. Thus, such prior art die casting machines are limited to casting rotors of a certain minimum stack height or require the manual insertion or removal of spacer plates to cast rotors of various stack heights, which is time consuming and therefore undesirable.

It is therefore desired to provide an improved automatic die casting machine that is particularly suitable for casting rotors for electric motors and wherein the cycle time of the machine is minimized. It is furthermore desired to provide such a machine which includes a full range of compensation. Lastly, it is desired to provide such a machine wherein the movable die cast portion is secured to a small movable platen which operates over a short distance and is clamped by means of hydraulic clamping cylinders.

SUMMARY OF THE INVENTION

The present invention overcomes the disadvantages of the above-described prior art die casting machines by providing an improved automatic die casting machine therefor.

The present invention provides a fully automatic, high production, rotor die casting machine which, by use of an indexing turn table and other tooling, as hereinafter described, simultaneously performs multiple operations. The required operations for die casting a rotor are performed at three stations so that all operations at each station are completed in an equal amount of time. Thus no station is idle for any excess amount of time and optimum cycling time is achieved. The machine arrangement further provides certain tooling elements as fixed, as opposed to movable, items, which arrangement is conducive to provide maximum efficiency. The machine further provides a full range of compensation for various rotor stack heights, the injection of molten shot material through a movable clamping member, and the arrangement of the injection and clamping units to provide for optimum efficiency of the machine.

The machine according to the present invention, in one form thereof, provides a rotatable turret with three stations. At the first station the casting and compensation functions are performed, at the second station the pin pressing and trimming operations are performed, and at the third station the unloading and loading operations are performed. The machine further includes a compensating section having one or more double action compensator hydraulic cylinders to provide a full range of compensation. The compensating section is stationary and of relatively small mass. A movable die holding block or traveling plate which operates over a short stroke is provided for closing the die casting cavity. The injection is made from the end of the machine at which the clamping cylinders are located and the injection is, therefore, made through a movable clamping plate.

One advantage of the present invention is that the cycle time for die casting a part is reduced as compared to prior art machines. The dictating factors for cycle time are the shot weight and metal solidification time. All other elements are worked simultaneously and within this time frame.

Another advantage of the present invention is that the machine is relatively simple in construction.

Yet another advantage of the present invention is that a full range of compensation is provided.

Still another advantage of the present invention is that a relatively light-weight movable tooling member or movable platen is moved over a relatively short distance to complete the die casting cavity, thereby improving machine cycle time.

A further advantage of the present invention is that the small movable platen is operated by hydraulic clamping cylinders which are easily adjustable over a wide pressure range and which provide for smooth, shock-free operation.

A yet further advantage of the present invention is that all die cast parts within selected size groupings may be cast at a uniform chamber pressure.

A still further advantage of the present invention is that the compensating and injecting operations are accomplished very simply and advantageously.

A yet still further advantage of the present invention is that the machine may be constructed as either a side gate casting machine or a pin-point gating machine.

The present invention, in one form thereof, comprises a die casting apparatus for performing a complete die casting operation, the operation including a plurality of functions. The apparatus includes a frame having at least two stationary opposed pressure plates and a rotating turret member disposed between the two stationary plates. A turret member includes a plurality of stations which have tooling located adjacent thereto for simultaneously performing at least one function of a die casting cycle at each of the stations. The operations which are to be performed at each station are selected so that the time required for completion of the operations at each of the plurality of stations is approximately equal.

The present invention, is one form thereof, comprises a die casting apparatus for forming rotors for electric motors. The apparatus includes a frame having at least two opposed stationary pressure plates and a rotating turret operatively mounted between these stationary plates. A plurality of die apertures are located in the turret at respective locations which are circumferentially spaced at regular intervals around the turret. The apertures are adapted to cooperate with tooling for forming a rotor. Casting and compensating tooling is operatively associated with the turret for die casting a rotor. Pin pressing and trimming tooling is operatively associated with the turret for pressing pins from die cast rotors and for trimming sprue material from die cast rotors. Unloading and loading tooling is operatively associated with a turret for unloading completed rotors from the turret and for loading rotor lamination stacks into the turret. The casting and compensating tooling, the pin pressing and trimming tooling, and the unloading and loading tooling are respectively arranged to substantially simultaneously perform respective operations at the respective locations of the turret in substantially equal amounts of time.

The present invention in one form thereof comprises a method for die casting rotors for electric motors and a die casting apparatus. A die casting apparatus includes a rotatable turret having first, second, and third stations and having a plurality of tooling operatively associated therewith. The method comprises compensating for a variable rotor stack thickness and casting at least one rotor at the first station in a predetermined amount of time. Simultaneously with the compensating and casting operations at the first station, an alignment pin is pressed out of at least one rotor and runner material is trimmed from the rotors at the second station in substantially the predetermined amount of time. Simultaneously with the compensating and casting operations at the first station, at least one rotor is unloaded from the turret at the third station and thereafter a stack of laminations is loaded into the turret at the third station in substantially the predetermined amount of time.

It is an object of the present invention to provide a die casting machine wherein the time required for completing a die casting cycle is minimized.

A further object of the present invention is to provide a die casting machine which is compact and relatively simple in construction.

Another object of the present invention is to provide a die casting machine which provides a full range of compensation for rotors of various stack heights.

Still another object of the present invention is to provide a die casting machine wherein the traveling distances of the movable members are relatively short.

Yet a further object of the present invention is to provide a die casting machine wherein constant casting pressures are provided for rotors of various sizes.

Still a further object of the present invention is to provide a die casting machine wherein the shot delivery system is located at the same end of the machine as the clamping cylinders.

Yet another object of the invention is to provide a very effective yet simple method for trimming a die cast part and for ejecting the part from the machine.

BRIEF DESCRIPTION OF THE DRAWINGS

The above-mentioned and other features and objects of this invention, and the manner,. of attaining them, will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
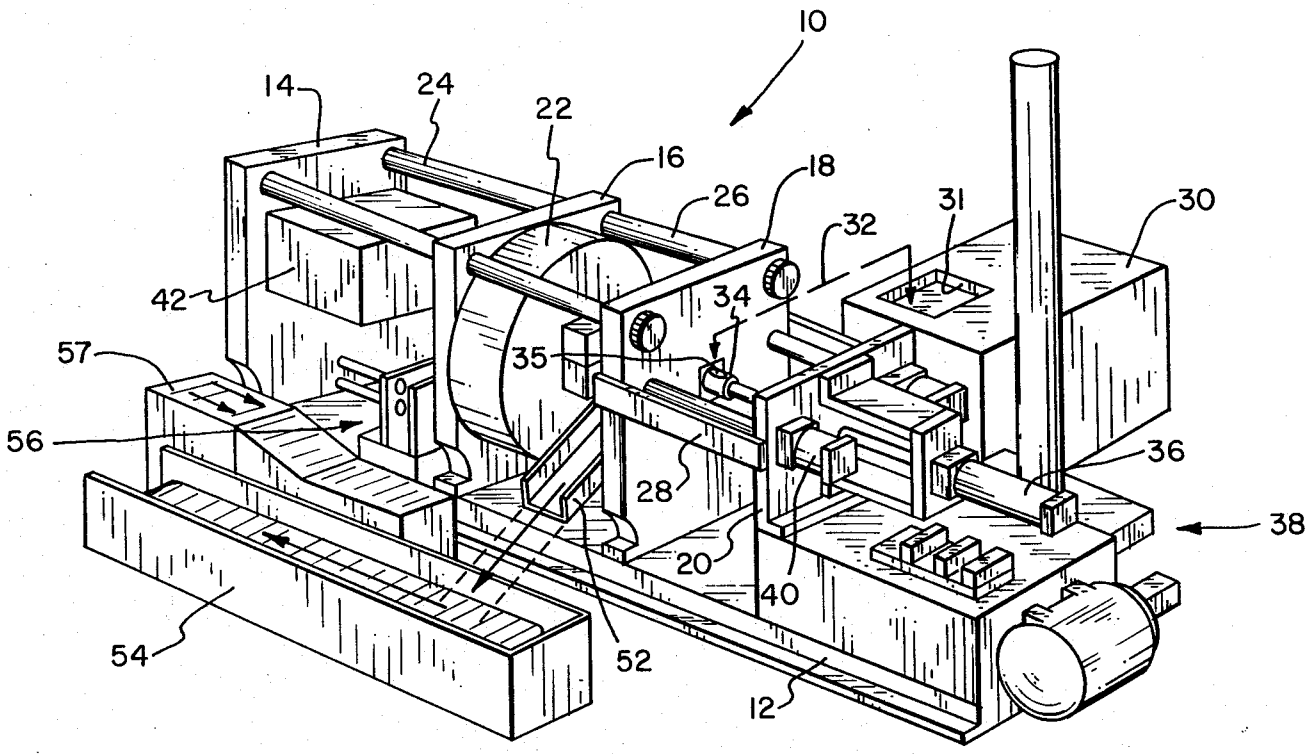
FIG. 1 is a perspective front view of a side gate version of the die casting machine according to the present invention.

Referring now to FIG. 1 there is shown a perspective view of the die casting machine 10 according to the present invention. While the disclosed embodiment is shown on a side gate casting machine, it should be understood that the machine could also be shown as a pin gate version. Machine 10 includes a frame 12 on which are mounted stationary plates 14, 16, 18, and 20. A rotatable turret 22 is also mounted between plates 16 and 18 as further explained hereinafter. Plates 14 and 16 are secured together by two tie rods 24 and plates 16 and 18 are secured together by means of two tie rods 26. Plates 18 and 20 are furthermore secured together by means of two tie rods 28. A metal melter 30 is provided for melting the die cast metal. The die casting metal may be any suitable metal such as high purity aluminum but may also be other suitable alloys. The molten metal is transferred by a ladle (not shown) from the melter through an aperture 31 in metal melter 30 over a travel path shown in dotted line 32 and into an inlet opening 35 in the cold chamber sleeve 34. A shot cylinder 36 is provided to move the charge of molten metal from the cold chamber into the die cavity. A hydraulic power unit 38 provides the clamping power for a movable clamping plate, as further explained hereinafter.

Referring further to FIG. 1, a stationary compensator tooling section 42 is also shown to provide the compensating function which makes it possible to adjust the interior volume of the die casting cavity to accommodate rotor bodies having various stack heights. Compensator tooling section 42 is fixedly secured between plates 14 and 16. A rotor unloading chute 52 is provided whereby rotors, after being unloaded from turret 22, are guided to a rotor unloading conveyor 54 or other suitable conveying means. Also provided are a rotor lamination stack loading section 56 and a loading conveyor 57, as further explained hereinafter. While the invention has been illustrated for manufacturing rotors, it should be understood that the invention is not so limited and may be embodied in a machine for die casting other parts.

Figure 3:
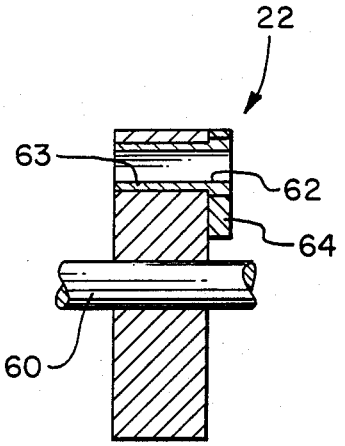
FIG. 3 is a cross sectional view of the turret taken along lines 3—3 of FIG. 2.
Figure 2:
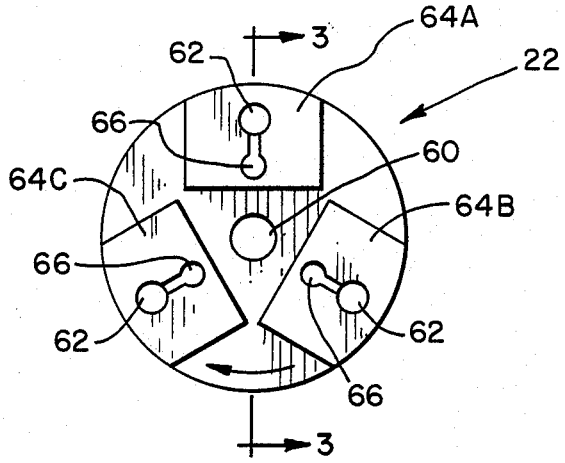
FIG. 2 is a front elevational view of the turret of the machine of FIG. 1.

Referring now to FIGS. 2 and 3, turret 22 is shown in greater detail. For purposes of illustration and not by way of limitation, a single cavity turret is shown for casting rotors for electric motors. However it should be understood that the turret could be provided with multiple cavities whereby multiple rotors may be cast simultaneously. Turret 22 is mounted on a central turntable pivot bar 60 which also serves as a tie bar to secure plates 16 and 18 in the disclosed embodiment. A sleeve 71 serves as a spacer between plates 14 and 16. The turret or turn table 22 is rotatable and has three gating biscuit plates 64*a*, 64*b* and 64*c* secured thereto at positions or stations which are spaced around the turret at 120° intervals. Thus, turret 22 has three stations and operations may be simultaneously performed at these three turret stations. While turret 22 may be formed of any suitable material such as mild steel or aluminum, the gating biscuit plates 64 are preferably made of tool steel since the hot die cast metal will contact only the gating biscuit plates which are able to withstand the high temperatures so that and turret 22 is not damaged by the hot molten metal. Biscuit gating plates 64 are secured to turret 22 in any suitable manner and may be removable. Gating plates 64 may also be water cooled, as is conventional, and may also be lubricated, if desired.

One very important aspect of the invention is that the operations to be performed in die casting a part have been so arranged and divided between the three stations that the amount of time necessary to simultaneously complete the operations at each station is approximately equal for all three stations. The dictating factors for the cycle time are shot weight and metal solidification time. The operations selected to be performed at the first station are the compensating and casting operations.

The operations selected to be performed at the second station are the pin pressing and trimming operations, and the operations selected to be performed at the third station are the loading and unloading operations.

For purposes of illustration, the casting operation has been illustrated to take place at the twelve o'clock position of the biscuit gate plate 64A as shown in FIG. 2. A die cavity 62 is provided in turret 22 which has a liner sleeve 63 disposed therein whereinto the rotor lamination stack is loaded, as further explained hereinafter. Sleeves 63 which are provided in each die cavity 62, are manufactured of hardened tool steel. A runner cavity or sprue cavity 66 is provided into which the hot molten metal is transferred by the shot cylinder from the cold chamber as further explained hereafter. The hot molten metal then is forced into the die cavity.

It should also be noted that a mechanism must be provided for very accurately aligning the rotating turret 22 each time turret 22 is rotatably indexed. In the disclosed embodiment, when the turret is stopped at an indexing position, a locking cylinder (not shown) locks turret 22 accurately in place whereafter the compensating and casting operations may begin.

Figure 4:
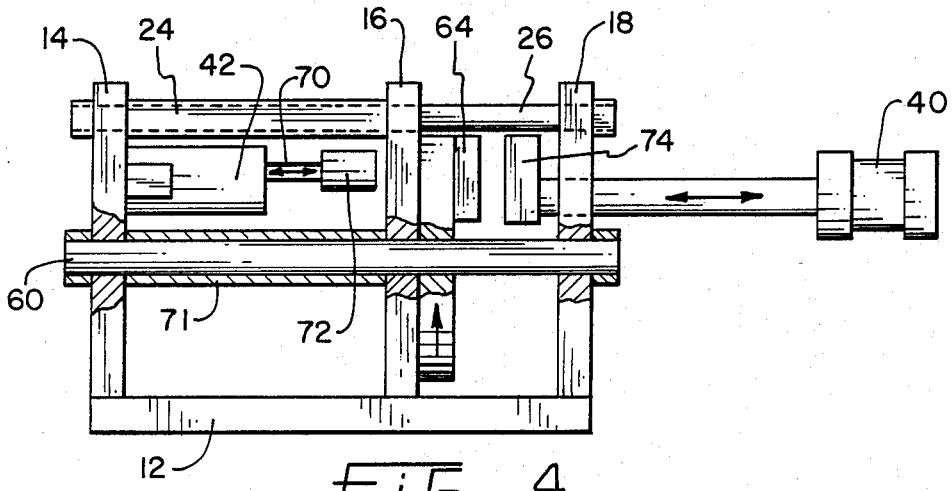
FIG. 4 is a front elevational view of the clamping system for the machine of FIG. 1.

Referring now to FIG. 4, a cross sectional front elevational view of a portion of machine 10 is shown to illustrate the clamping system, the compensating section and the movable die plate gate end. Stationary compensating section 42 includes a conventional double action compensator cylinder 70 which, after the indexing of turret 22 is completed, moves a compensator cavity 72 rightwardly into position through an aperture in stationary plate 16 and partially into sleeve 63 in turret 22, to form the left hand portion of the rotor die cavity. At the same time, a movable die plate 74 or clamping plate including a gate end is moved into position against the biscuit gating plate 64 by means of a clamping cylinder 40. Movable die plate 74 forms the right-hand portion of the rotor die cavity. The apparatus is now ready for the casting operation.

One advantage of the present invention is that the movable die plate 74 is a relatively small, light-weight part which moves over a relatively small distance. In the disclosed side gate casting embodiment, die plate 74 moves only three and one-half (3½) inches from the fully open to the fully closed position and a greater movement range could be accommodated. For instance, in a pin gating machine embodiment of the invention, the die plate moves a distance of about seven and one-half (7½) inches. The double staging for pin gate requirements would be split with three and one half (3½) inches for turret clearance and four (4) inches for gate removal. Thus, not only is light-weight die plate 74 more easily movable, but the relatively short distance over which plate 74 is moved saves further cycle time.

Figure 5:
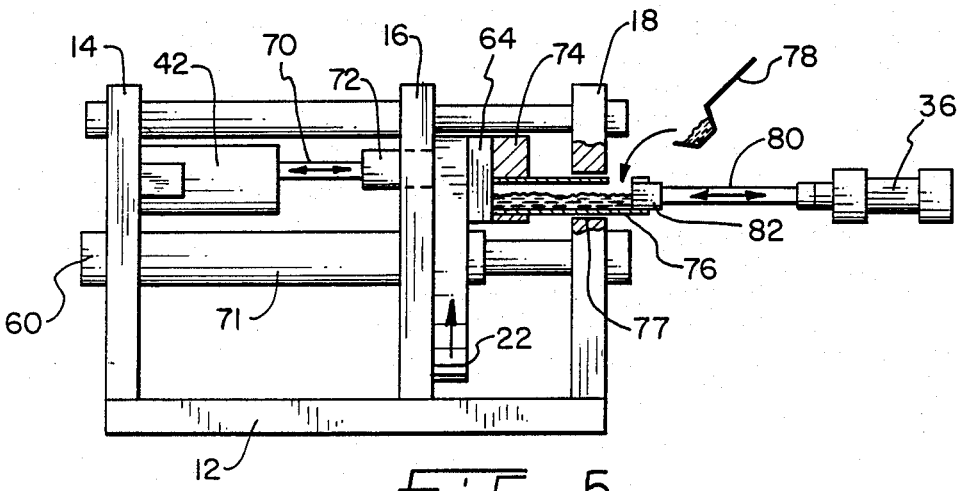
FIG. 5 is the front elevational view, partly in cross section, of the shot mechanism for the machine of FIG. 1.

In FIG. 5 it can further be seen that compensator cavity 72 has been moved into position by compensator cylinder 70 into the left-hand side of sleeve 63 in turret 22. At the same time, the movable die plate 74 is shown in its closed position against the right-hand side of turret 22. Furthermore, the cold chamber sleeve 76 which extends through aperture 77 in stationery plate 18 has been supplied with hot molten metal from the ladle, diagrammatically shown at 78, so that the stationary shot cylinder 36 is now in position to move shot rod 80 toward the left whereby ram 82 forces the hot molten metal through the runner system in die plate 74 and into the die cavity.

Figure 9:
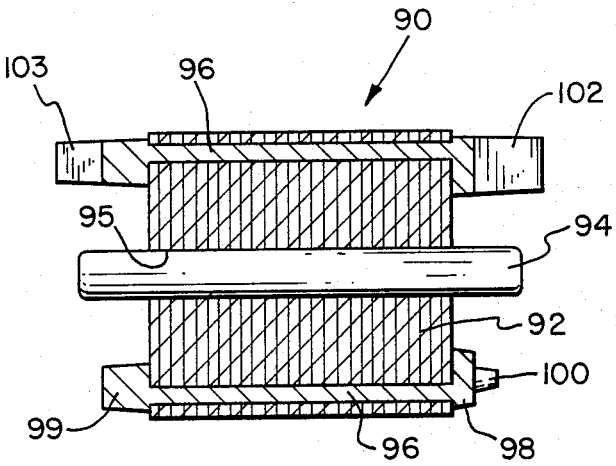
FIG. 9 is a cross sectional view of a die cast rotor for an electric motor.

Turning now to FIG. 9, for purposes of illustration of the operation of the machine, a completed rotor is shown. The rotor comprises a stack of soft iron laminations 92 which are held together by means of a removable stack pin 94, which is disposed in aligned central apertures of the laminations which form an aperture 95. The laminations further include a plurality of apertures located around the outside circumference of the laminations. The laminations are stacked so that the outside apertures align to form a series of skewed bores through the stack. The bores provide channels into which the hot molten metal is injected, thereby forming a series of conductor bars 96 as shown and as is well known in conventional squirrel cage rotors. A pair of end rings 98 and 99 are provided to interconnect conductor bars 96 whereby current may be induced in the rotor as it revolves within the stator of an electric motor. The lamination stack height is a matter of designer's choice depending upon the desired characteristics and application of the electric motor. Furthermore, the diameter of the rotor may also be varied depending upon the desired characteristics and application of the motor.

Figure 6:
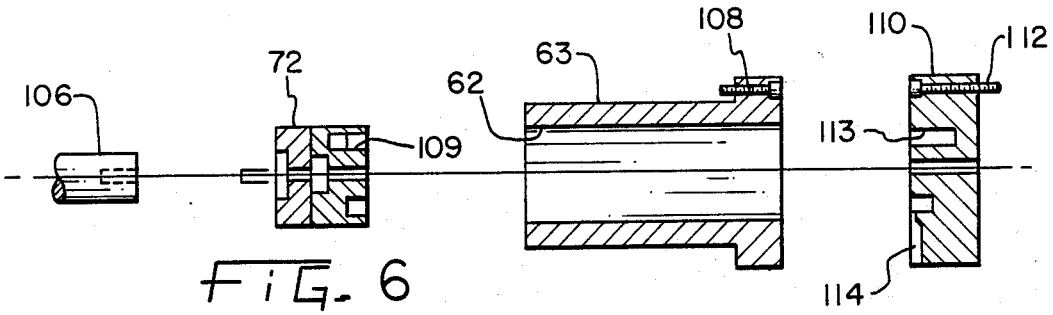
FIG. 6 is an exploded view of the die cavity tooling for the machine of FIG. 1.
Figure 7:
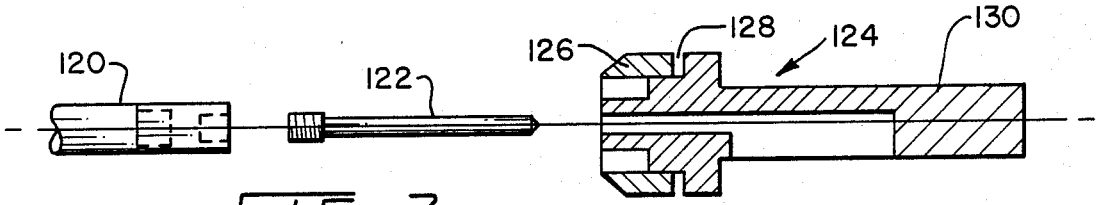
FIG. 7 is an exploded view of the pin press and trim die tooling for the machine of FIG. 1.
Figure 8:
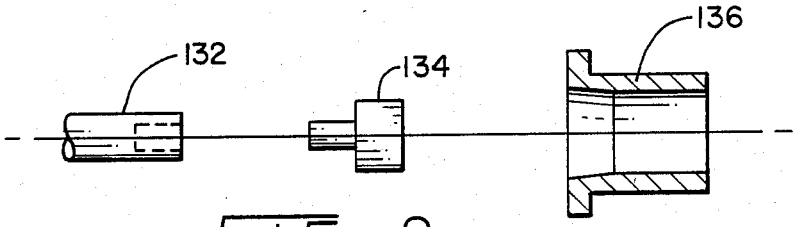
FIG. 8 is an exploded view of the load and unload tooling for the machine of FIG. 1.

Referring now to FIGS. 6, 7, and 8, the tooling components for manufacturing the die cast rotor are shown. FIG. 6 shows end tooling comprising the compensator cavity 72 which is driven by means of a rod 106 and the compensator cylinder 70 which is housed in stationary compensator tooling section 42. As can be plainly seen from the cross sectional representation of compensator cavity 72, the end ring 99 of rotor 90 is formed in cavity 109 of compensator cavity 72. Cavity sleeve 63 has a threaded fastener 108 disposed in an aperture thereof for securing sleeve 63 in turret 22. Further shown is further end tooling comprising a gate cavity 110 which is secured to the movable die plate 74 by means of threaded fasteners 112. The gate cavity 110 includes an end ring cavity 113 for forming the end ring 98 of rotor 90. Gate cavity 110 further includes a runner cavity 114 through which the hot molten metal travels from cold chamber sleeve 76 into the rotor die cavity. The tooling of FIG. 6 is mounted at the twelve o'clock station of turret 22.

Turning now to FIG. 7, the tooling for pressing the stack pin 94 from a completed rotor 90 and for trimming the runner or sprue material 116 from the completed rotor 90 is shown. A stem press rod 120 is shown which is activated by a hydraulic cylinder as described hereinafter. Rod 120 engages with a presser stem 122 for pressing stack pin 94 from a completed rotor 90. A trim die and stripper assembly 124 is also shown including a trim die 126 which is mounted on the stripper 130. A space 128 is provided between trim die 126 and stripper 130 whereby the trim die is axially movable with respect to stripper 130, as further explained hereinafter. The tooling of FIG. 7 is mounted at the four o'clock station of turret 22 adjacent a biscuit gate plate 64B as shown in FIG. 2.

Turning now to FIG. 8, the loading and unloading tooling is shown which is mounted at the eight o'clock station of turret 22 adjacent a biscuit gate plate 64C as shown in FIG. 2. A loading rod 132 is shown for engaging with a feed button 134 to load rotor lamination stacks 94 into sleeve cavity 63 of turret 22. Furthermore, a feed sleeve 136 is shown and into which a completed rotor assembly 90 is pressed by feeder rod 132 and feed button 134 after the rotor assembly has been completed, the stack pin 94 has been pressed out of the rotor assembly 90 and the runner has been removed therefrom in the press and trim station.

Figure 10A:
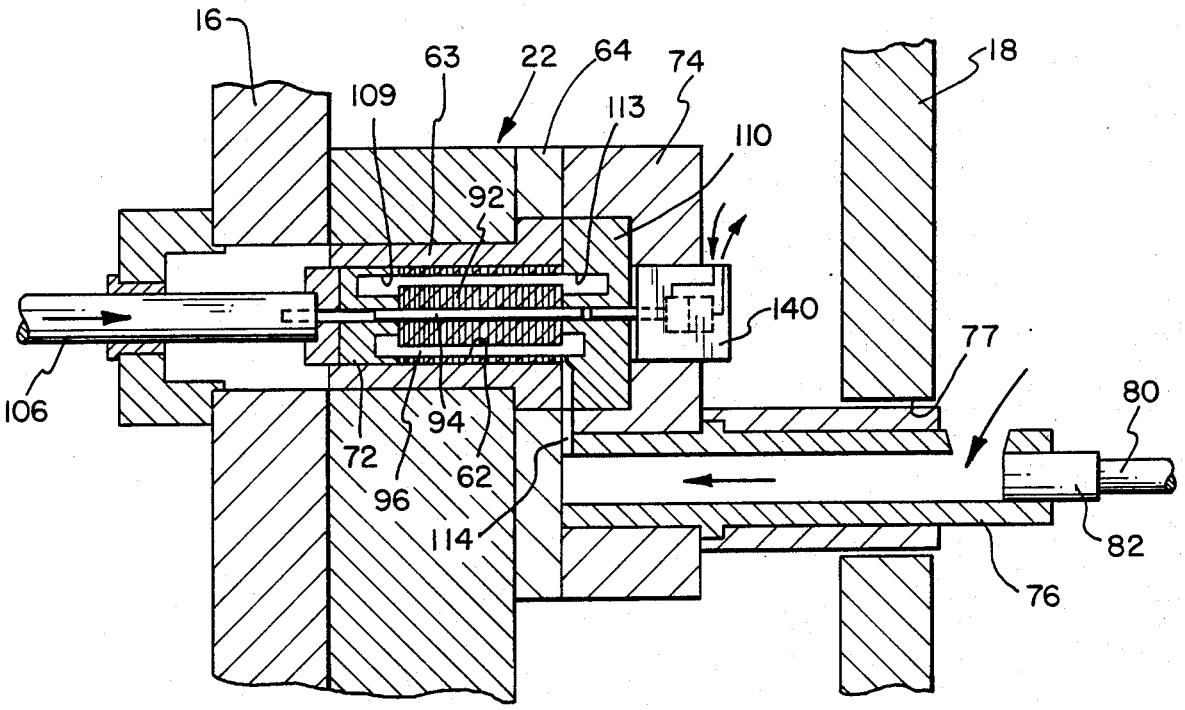
FIG. 10*a* is a partial view, in cross section, of the side gate machine of FIG. 1 during a shot making operation.
Figure 10B:
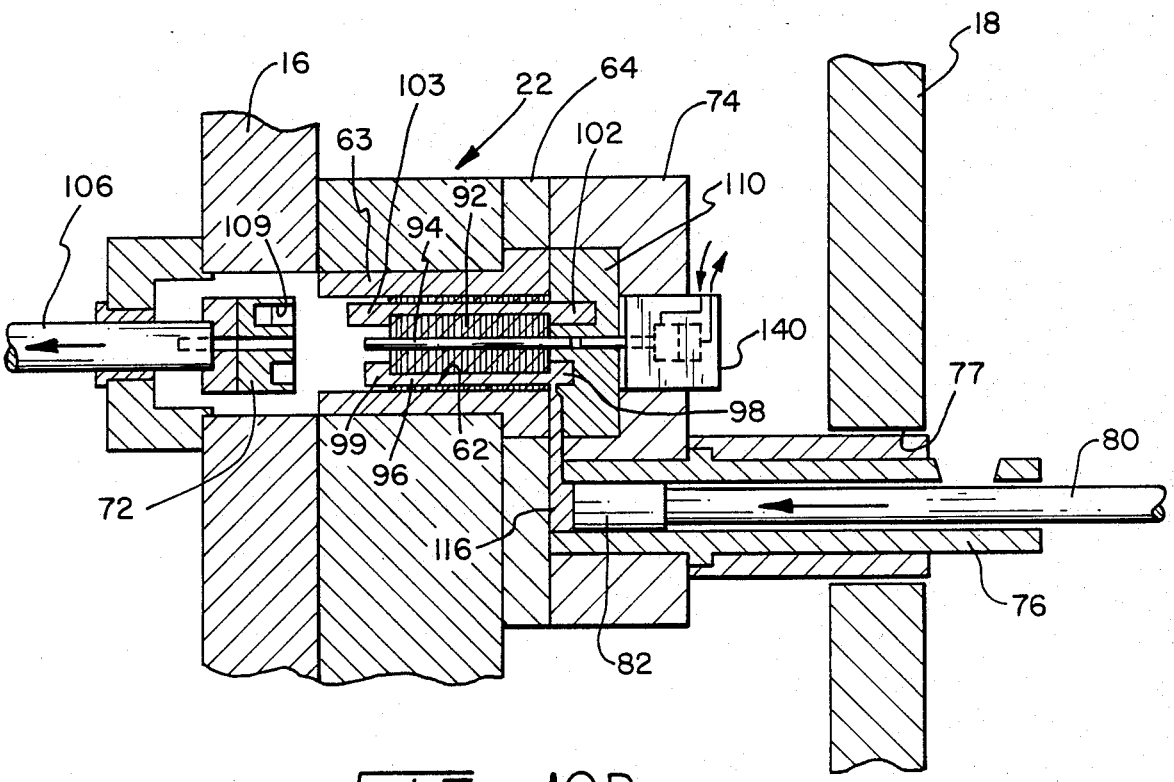
FIG. 10*b* is a partial view, in cross section, of the machine of FIG. 1 during a shot holding operation.
Figure 10C:
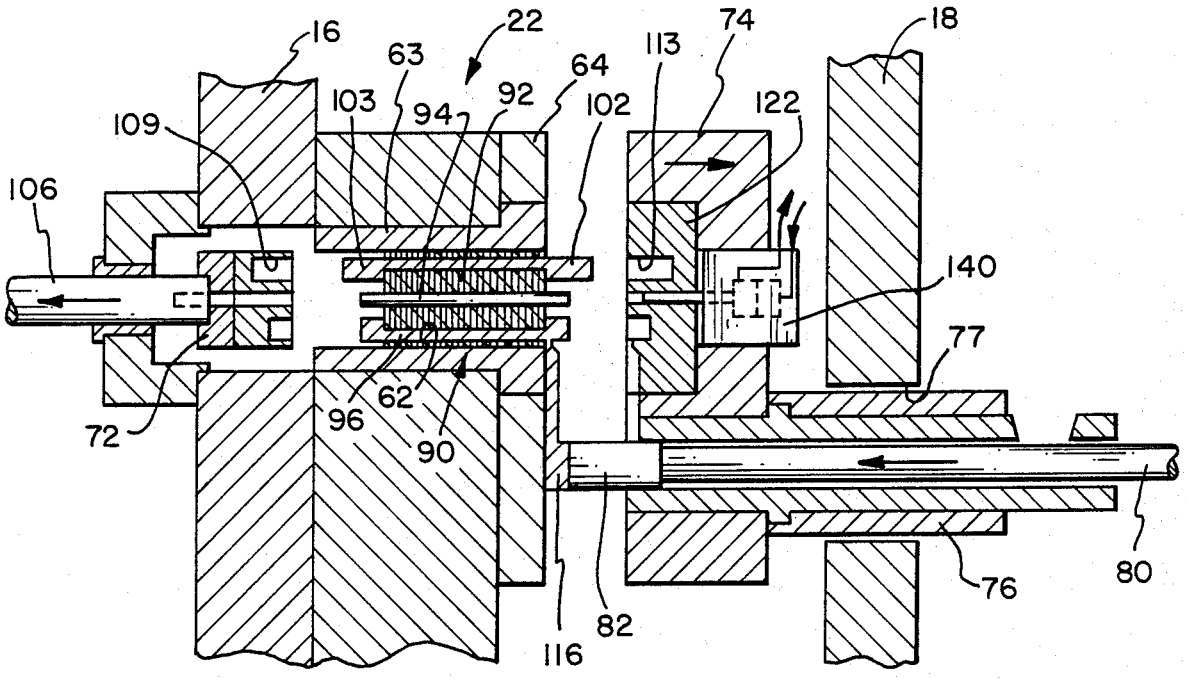
FIG. 10*c* is a partial view, in cross section, of the machine of FIG. 1 a die casting operation and before the turret is indexed.

Referring now to FIGS. 10*a*, 10*b*, and 10*c*, the operations to be performed at the compensating and casting station at the twelve o'clock station of turret 22 are shown. FIG. 10*a* shows the compensator 72 located in the die casting position within cavity sleeve 63 of turret 22. Compensator 72 is engaged with the left-hand side of lamination stack 92. At the right-hand side of turret 22, the movable die plate 74 has been moved into the die casting position by clamp cylinders 40. At this time, the gate side ejector cylinder 140 is back in the right-hand position. Cylinder 140 is required in cases where the rotor design has greater shrinkage or binding in the gate half only, and is an auxiliary device. Thus cylinder 140 is used only when needed to prevent rotors sticking in the gate side. When used, cylinder 140 is operated forwardly simultaneously with clamp retraction to assist in sticking the rotor to the correct turret side. It should be noted that the amount of travel of the movable die 74 is only three and one half (3½) inches in the disclosed side gated embodiment instead of the relatively large travel distance of the movable die plate of conventional die casting machines. As stated above, the movable die will travel about seven and one-half (7½) inches in a pin gating embodiment of the invention. It can also be seen that cold chamber sleeve 76 is in position to receive a charge of molten metal whereupon ram 82 forces the molten metal, by the operation of shot rod 80, through the runner system and into the die cavity comprising cavity 109 in compensator 72, cavity 113 in gate cavity 110, and the channels formed by the aligned apertures in the lamination stack 92.

Turning now to FIG. 10*b*, it can be seen that ram 82 has moved into position to force the molten metal into the die cavity and that the shot is holding to permit the metal in the die cavity to solidify. At this time, compensator 72 has moved leftward and end ring 99 has already solidified. The gate side ejector cylinder 140 is still in the back position.

Turning now to FIG. 10*c*, the gate side ejector cylinder 140 has moved forwardly as the movable die 74 retracts together with the shot sleeve 76. It can be seen that ram 82 is in position to retract whereby turret 22 is ready to rotate together with the completed rotor assembly 90 and the attached solidified sprue or runner 116.

Figure 11:
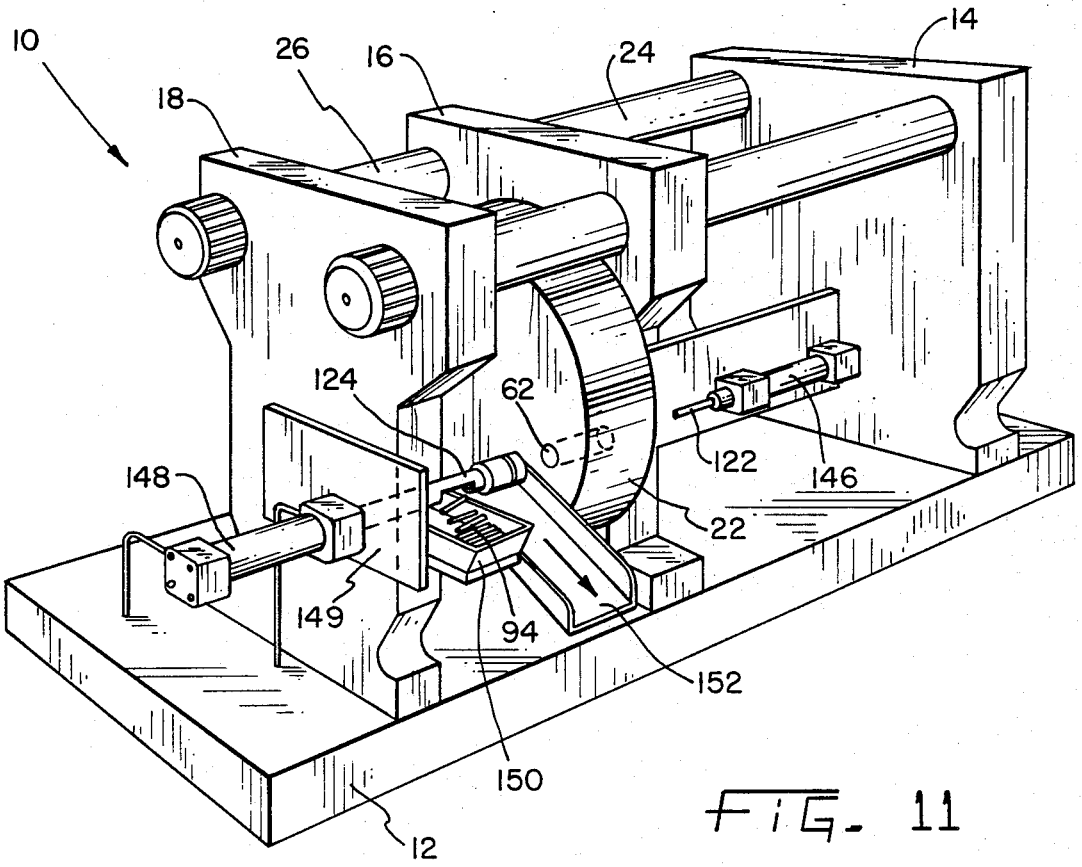
FIG. 11 is a perspective rear view of the machine of FIG. 1 including the pin press out, trim and scrap removal portions of the machine.

Turning now to FIG. 11, a perspective rear view of the die casting machine is shown. A pin press out cylinder 146 is shown as well as a trim cylinder 148. Further, the trim die and stripper assembly 124 is shown. Lastly, a pin discharge pan 150 is shown for receiving stack pins 94 after they have been pressed out of a completed rotor and a gate scrap discharge chute 152 is shown for receiving discarded sprues or runners.

Turning now to FIGS. 12*a*–12*e*, the operation of the trim and pin press sequence, as performed at the four o'clock station of turret 22, is seen. By referring to FIG. 12*a*, it can be seen that, after a rotor 90 has been cast and the turret 22 has rotated so that a cast rotor 90, including the attached solidified sprue or runner 116, has rotated from the twelve o'clock station to the four o'clock station, the presser stem 122, is in the back position and at rest. At this point, the trim section 124 is also in the back position and at rest.

Figure 12A:
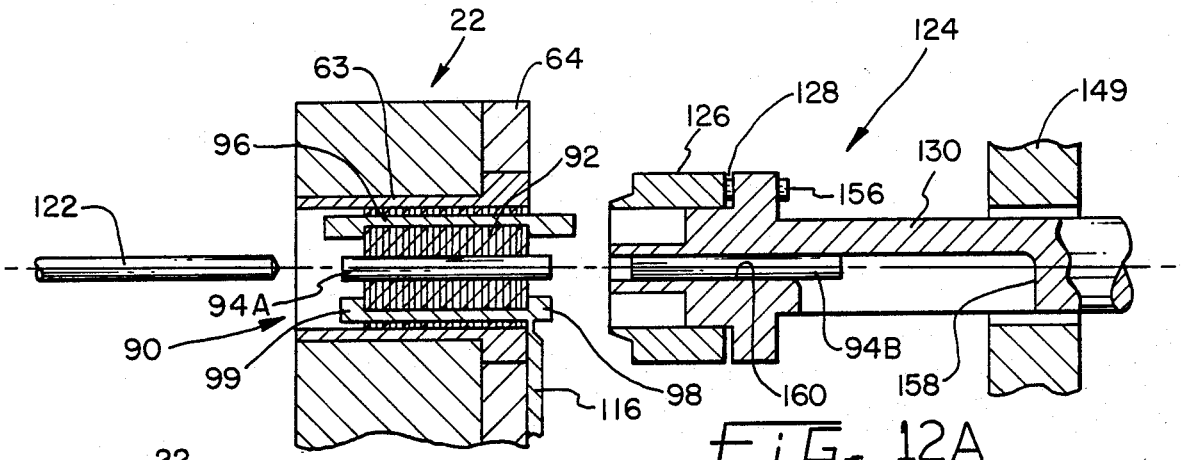
FIGS. 12*a*–12*e* are partial, cross sectional views of the machine of FIG. 1 during the trim and pin press operation sequence.
Figure 12B:
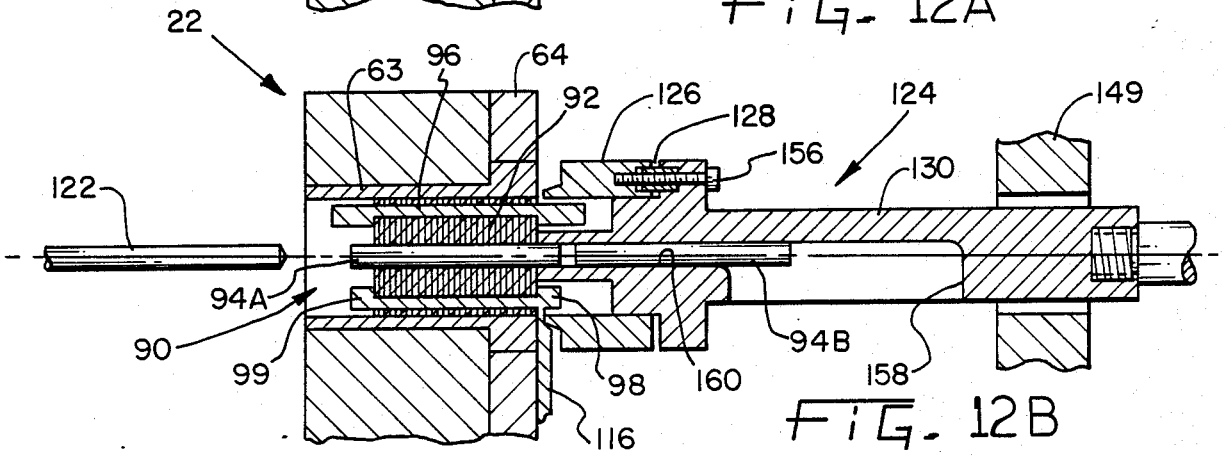
Figure 12C:
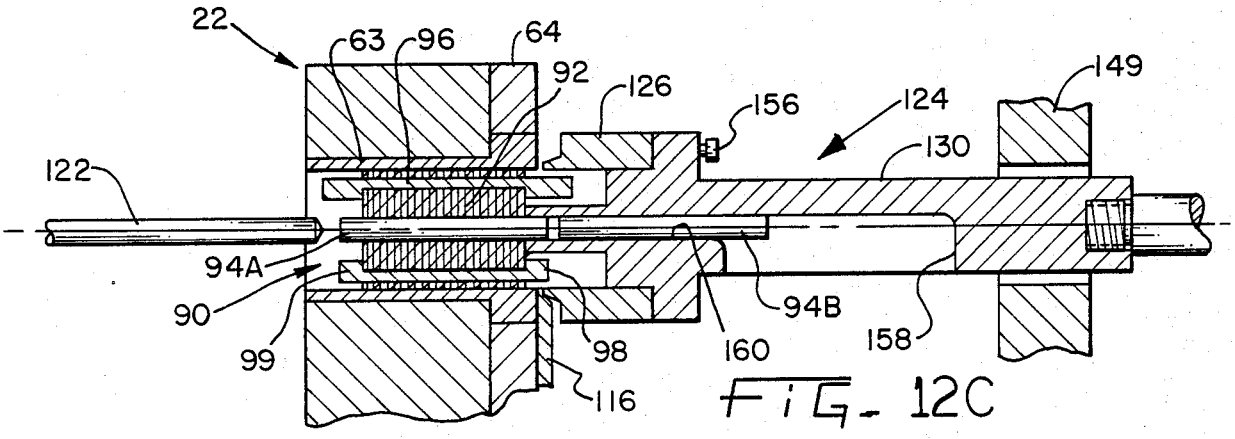
Figure 12D:
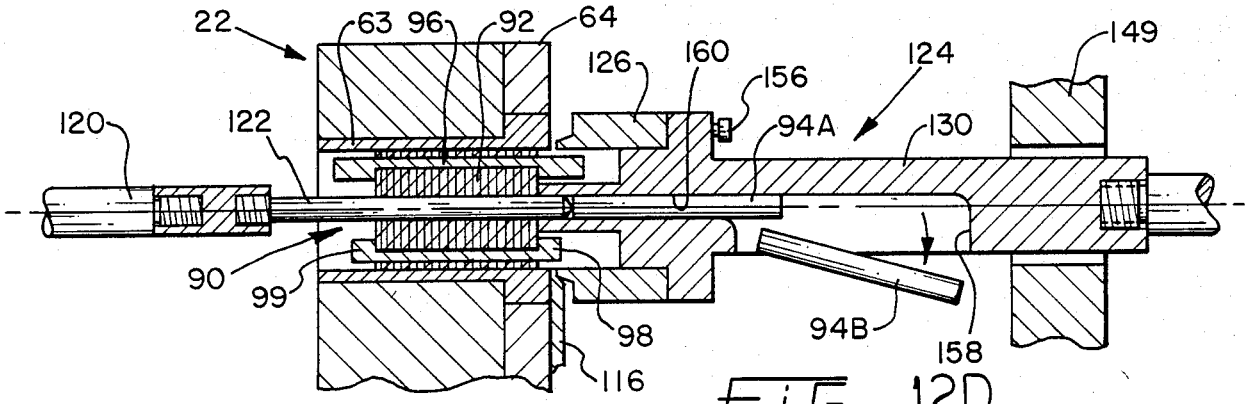
Figure 12E:
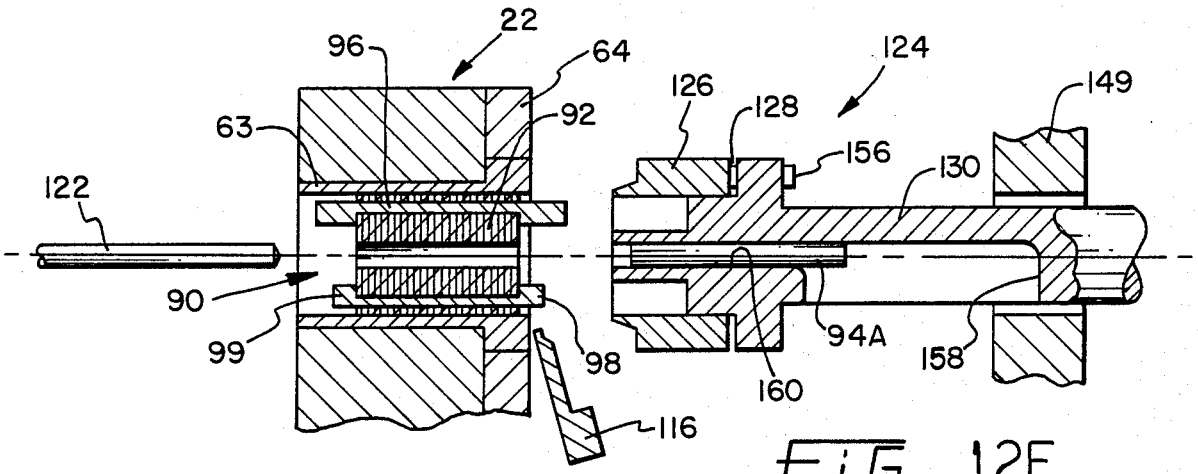

An important aspect of the current invention is the simple but effective method and apparatus for trimming the sprue 116 from the completed rotor 90. Trim section 124 includes trim die 126 which, as shown in FIGS. 7, 12*a* and 12*b* is spaced from stripper 130 by means of a space 128, which spacing may be provided by a spring or other suitable basing device. A plurality of bolts 156, which may be spring loaded, secures trim die 126 to stripper 130. In FIG. 12*b*, the trim section has been moved against rotor 90 whereby stripper 130 engages with the right-hand side of the lamination stack 90, as shown. At this point, stripper 130 only just contacts the rotor but has yet not moved the rotor. Further, trim die 126 has just engaged with sprue 116. As shown in FIG. 12*c*, stripper 130 has now advanced further thereby moving rotor 90 leftwardly, thus closing gap 128 between trim die 126 and stripper 130 so that the trim die 126 continues to engage with the runner or sprue 116. Thus sprue 116 is severed from rotor 90 but is retained and clamped in position against cavity sleeve 63. As seen in FIG. 12*d*, presser stem 122 is now moved to the right to engage with stack pin 94*a*. Presser stem 122 has thus continued its rightward movement and has forced stack pin 94*a* into aperture 160 of stripper 130 thereby forcing stack pin 94*b*, which had been retained in cavity 160, into open cavity 158, whereby pin 94*b* is free to drop into pin discharge pan 150 as shown in FIG. 11. Pin 94*a* is now retained in aperture 160 of stripper 130, from which it will be dislodged during the next pin press operation. With the completion of the pin press operation, presser stem 122 is now ready to be moved toward the left again. As can also be seen in FIG. 12*e*, the trim section 124 now moves to the right whereby the clamping force on sprue 116 is removed so that severed sprue 116 may drop downwardly into gate scrap discharge chute 152 (FIG. 11). It should be noted that, at this time, the lost motion provided by spring loaded bolts 156 permits gap 128 to be opened again between trim die 126 and stripper 130.

Figure 13A:
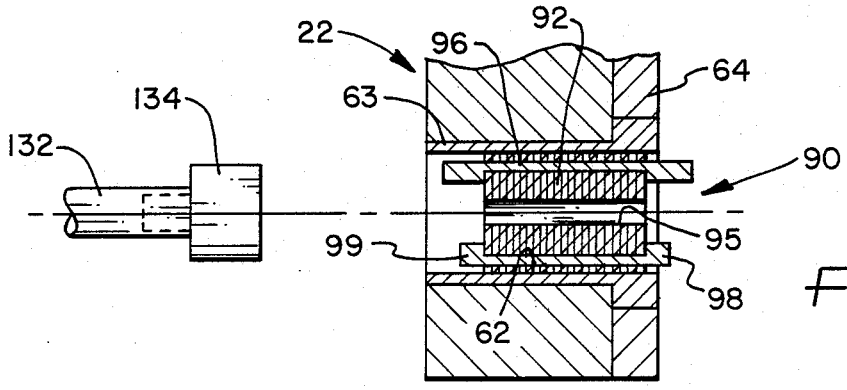
FIGS. 13*a*–13*d* are partial, cross sectional views of the machine of FIG. 1 during the unloading and loading sequence of the machine.
Figure 13B:
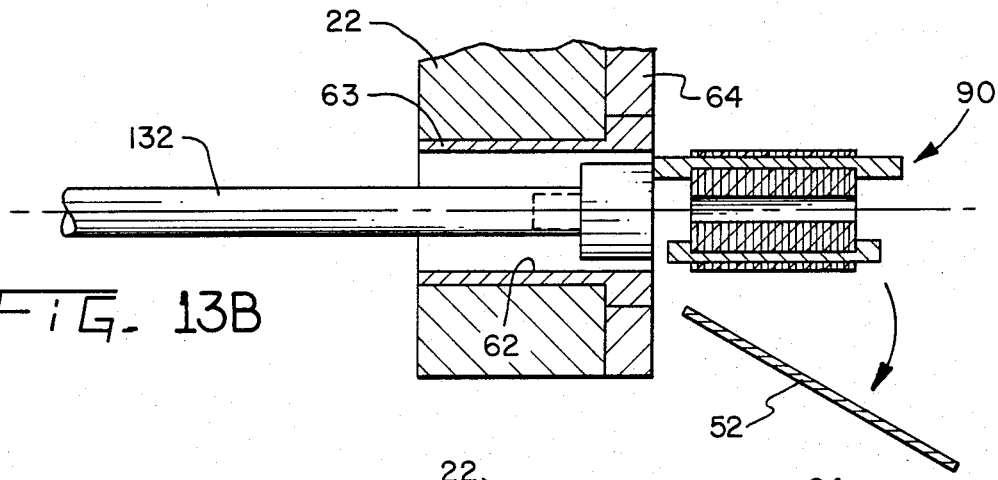
Figure 13C:
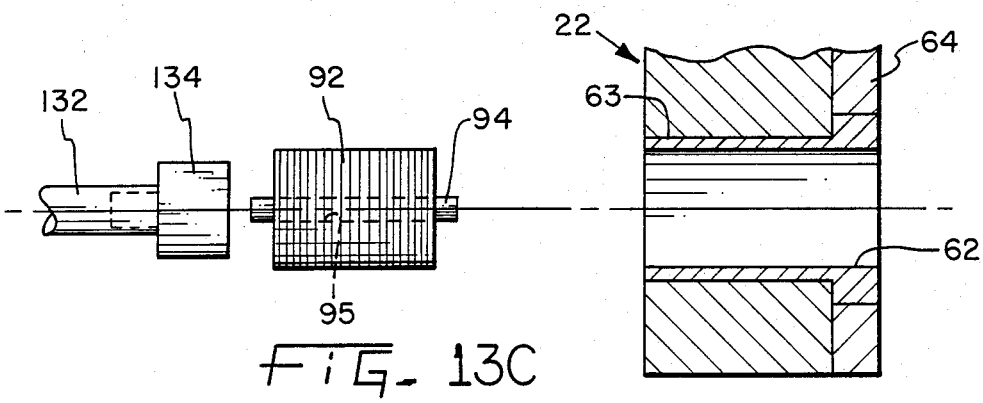
Figure 13D:
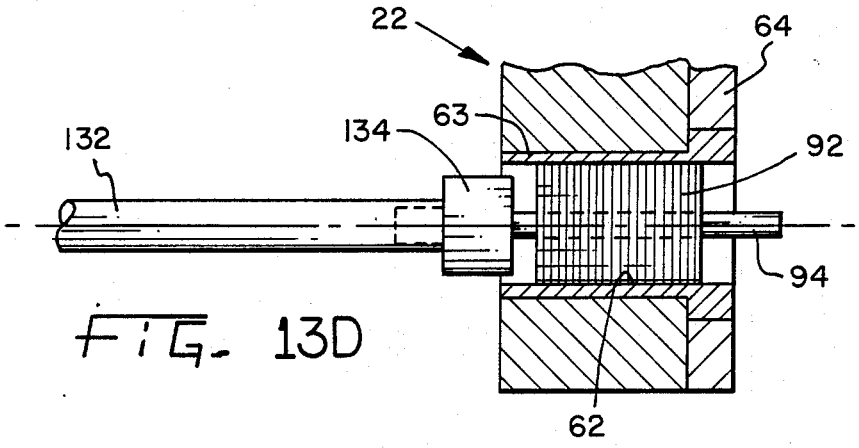

Turning now to FIGS. 13*a*–13*d*, the unloading operation of a completed rotor 90 is illustrated. The unload and load station is located at the eight o'clock position of turret 22. As shown in FIG. 13*a*, the pusher stem 132 and feed button 134 are in the retracted position and the completed rotor is housed in cavity 62 in sleeve 63 of turret 22. It should also be noted that no stack pin is located in the aperture 95 of lamination stack 92. As shown in FIG. 13*b*, pusher stem 132 has advanced to the right whereby feed button 134 has pushed completed rotor 90 toward the right and has ejected the rotor from sleeve 63 and onto a discharge chute 52 diagrammatically shown in FIG. 13*b* and in FIG. 1. As further shown in FIG. 13*c*, a new rotor stack 92 including a stack pin 94 is now ready for loading into sleeve 63. The pusher stem 132 and feed button 134 are again in their retracted positions. As the pusher stem 132 moves forwardly toward the right, feed button 134 will push the rotor stack 92 into cavity 62 and position stack 92 in its casting position as shown in FIG. 13*d*. Turret 22 is now ready for indexing rotatably to the twelve o'clock position wherein the hot metal is cast into the die cavities as explained hereinabove.

Figure 14:
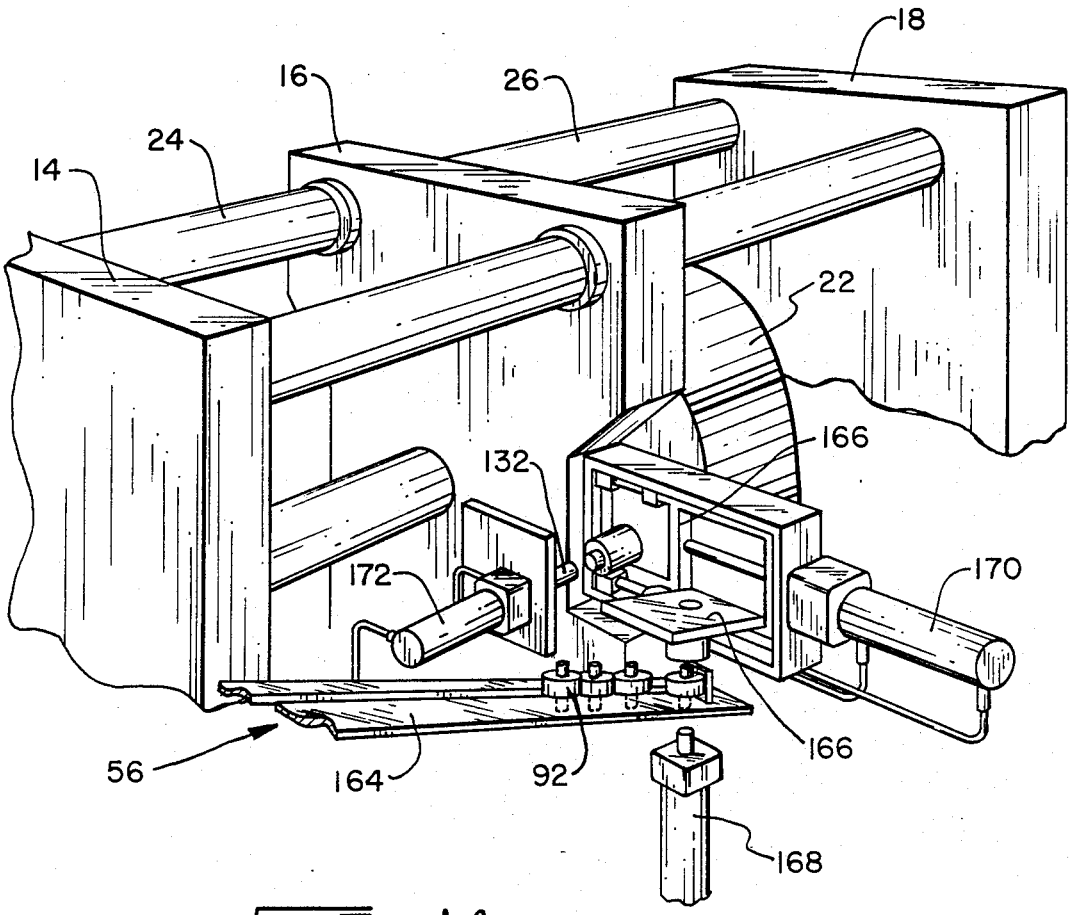
FIG. 14 is a partial perspective view of the loading mechanism of the machine of FIG. 1.

As best seen in FIG. 14, the rotor load section 56 includes a loading mechanism for removing rotor lamination stack 92 from a transporting mechanism such as loading chute 164 and to load the stacks into a loading member preparatory to loading the stacks into sleeve 63 of turret 22. Rotor lamination stacks 92 are aligned in a row on a loading chute 164 so that hinged loading member 166 may receive a rotor stack therefrom. While in the illustrated embodiment only one rotor stack 92 at a time is transferred to member 166 and turret 22, more than one stack could also be transferred simultaneously for a multiple cavity turret 22. Rotor stacks 92 are moved into loading member 166 by means of hydraulically operated cylinders 168. After loading of a rotor stack 92 into hinged member 166, member 166 is pivoted upwardly and is then aligned with respect to turret 22 by means of hydraulic cylinder 170. After this lateral positioning is completed, the stack 92 is loaded into turret 22 by means of a pusher cylinder 172 including pusher stems 132. It should be noted that the loading operation of the hinged loading member 166 from chute 164 may proceed while turret 22 is not yet in position to receive a new pair of rotor lamination stacks 90. One hinged loading member 166 is provided which moves laterally from the outboard position and receives a rotor from the transporter. Loading member 166 then moves inboard and aligns with the turret.

The operation of the apparatus is thus as follows. If it is assumed that turret 22 has just indexed in the direction of the arrow shown in FIG. 4, the locking cylinder end (not shown) will fully engage with a piloted bullet nose locator (not shown) to locate turret 22 accurately. In the twelve o'clock or die casting and compensating position of turret 22, there will be at this time a rotor stack 92 in cavity 62 of turret cavity sleeve 63. At the same time, a completed rotor 90 including a sprue 116 has rotated to the four o'clock position which is the pin press and trim position. The eight o'clock or unloading and loading position of turret 22 will have a completed rotor in cavity sleeve 63 for unloading after which a new lamination stack 92 is to be loaded.

In the casting station, the compensator will be moved into position against the lamination stack 92 and, at the same time, movable die plate 74 will move into position against the gating plate 64 and the turret 22. Molten metal is then poured into the cold chamber sleeve 76 and will be forced by the shot cylinder 36 through the runner cavity 114 and into the die cavities 109, and 113. While these operations are proceeding at the twelve o'clock station, stack pin 94 will be pressed out of the completed rotor 90 at the four o'clock station and, at the same time, the runner or sprue 116 will be trimmed from the completed rotor 90 and collected in a suitable receptacle at the eight o'clock station. At the eight o'clock station, a completed rotor will be unloaded from die cavity 62 and will be loaded onto conveyor 54. Thereafter, a new rotor lamination stack will be loaded into die cavity 62 in preparation for a die casting operation. When all operations at all three stations are completed, turret 22 is indexed and the same operations are repeated.

The operations at all three stations proceed simultaneously. The operations to be performed at the three locations have been chosen so that the amount of time taken to complete the operations at each station are as nearly equal as possible. Therefore, no time is wasted at any of the stations in waiting for completion of operations at any other station. The cycle time is thus optimized and machine productivity is increased.

Figure 15:
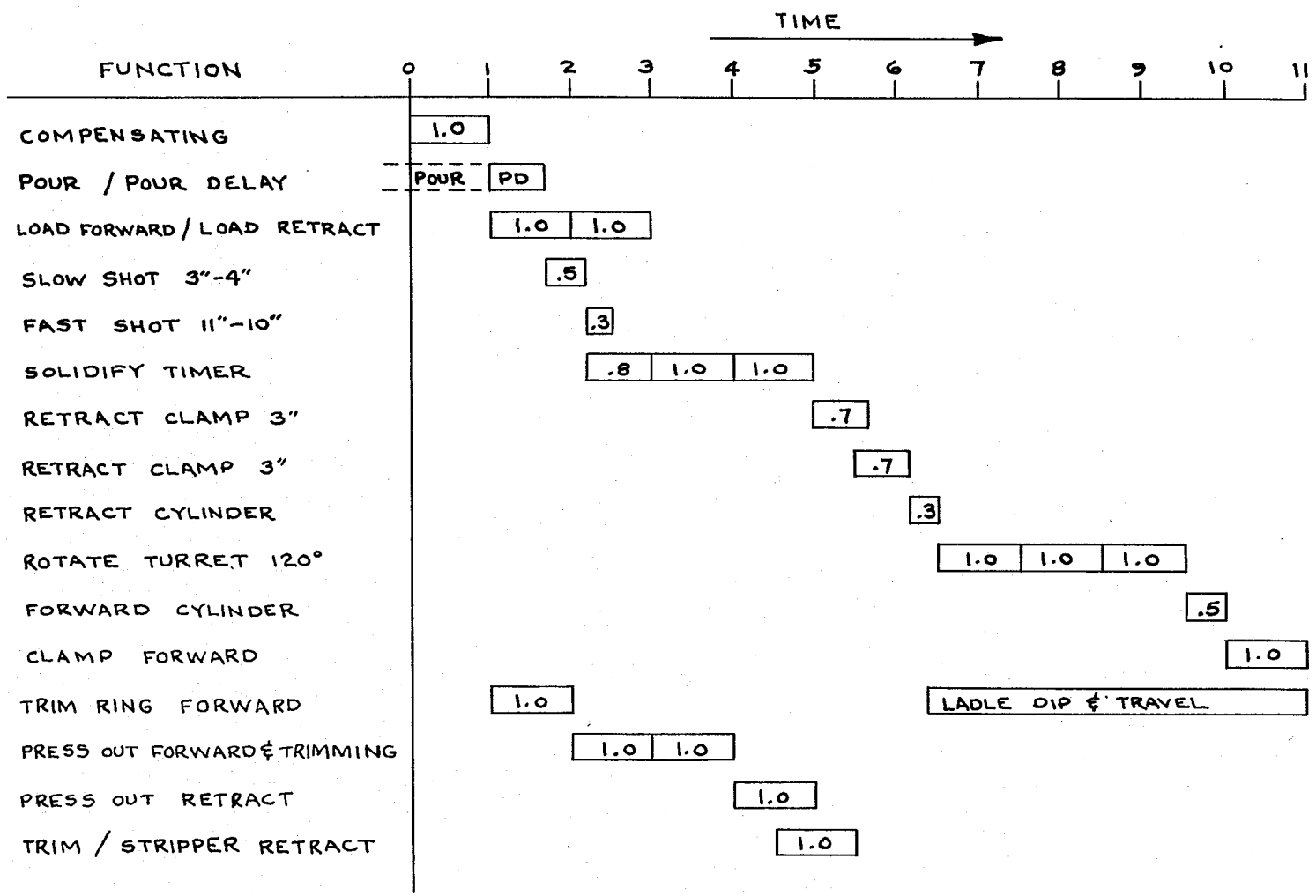
FIG. 15 is a time cycle chart for the machine of FIG. 1.

FIG. 15 shows a time cycle chart which illustrates the duration of a cycle. As clearly indicated, the times required for completing the operations which are to be performed at the twelve o'clock station, the four o'clock station, and the eight o'clock station are approximately equal. From the time cycle chart it can also be seen that the time required for metal solidification is a limiting factor for total cycle time. It can also be seen that the operation at the respective stations occur simultaneously. Further, it can be seen that the time required to rotate the turret is a limiting factor in establishing cycle time. Lastly, clamping and the time to make shot are limiting factors.

It has been found for example that a single cavity apparatus, according to the present invention, may have a cycle in the range of 11.7 seconds to 17.5 seconds for rotors having an outside rotor diameter ranges from 2 inches to 5 inches. This is a significant improvement over prior art machines wherein comparable cycle times conventionally were generally two to three times greater.

Thus what has been provided is a very effective, and very advantageous die casting machine which manufactures die cast parts, such as rotors in a minimum amount of time.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A die casting apparatus for performing a complete die casting operation, said operation including a plurality of functions, said apparatus comprising:

a frame including at least two stationary opposed pressure plates;

casting and compensating tooling comprising a pair of end tooling members respectively supported by said pressure plates;

a rotating turret member disposed between said two stationary plates in continuous fixed axial relationship therewith throughout cycling of the apparatus, said turret member comprising a plurality of die cavities, said turret means being rotatable relative to said end tooling members;

means for axially reciprocating said end tooling members relative to said turret;

a plurality of stations having tooling means located thereat for simultaneously performing at least one function of a die casting cycle at each said station as said turret rotates workpieces into position at said stations, said operations to be performed at each said station being selected so that the time required for completion of said operations at each of said plurality of stations is approximately equal.

2. The apparatus according to claim 1 wherein two operations are performed at each said station.

3. The apparatus according to claim 1 wherein said plurality of stations comprises three stations and wherein said means for performing at least one function comprises said casting and compensating tooling operatively associated with the first of said stations, a pin pressing and trimming means operatively associated with the second of said stations, and a loading and unloading means operatively associated with the third of said stations.

4. The apparatus according to claim 3 wherein one of said end tooling members includes a movable clamping member including an aperture therein and a means for injecting hot molten casting material through said aperture in said movable clamping member.

5. The apparatus according to claim 3 wherein said end tooling members include a movable tooling plate and a compensating member, said turret, movable tooling plate, and compensating member adapted to cooperate for forming a die cavity, said tooling plate adapted to move a distance in the range of three inches to eight inches between its operating and retracted positions.

6. The apparatus according to claim 3 wherein said pin pressing and trimming means includes means for clamping a sprue portion of said part to be cast and means for moving said part to be cast a predetermined distance relative to said sprue portion, whereby said sprue portion may be severed from said part to be cast.

7. The apparatus according the claim 3 wherein said pin pressing and trimming means includes multiple means including a clamping member for clamping a sprue to be formed and a rotor moving member for moving said rotor relative to said sprue, said clamping member and rotor moving member being relatively movable with respect to each other.

8. A die casting apparatus for forming rotors for electric motors, said apparatus comprising:

a frame including at least two opposed stationary pressure plates;

a rotating turret operatively mounted between said stationary plates in continuous fixed axial relationship therewith throughout cycling of the apparatus;

a plurality of die cavities in said turret at respective locations circumferentially spaced at regular intervals, said cavities adapted to cooperate with tooling means for forming a rotor;

casting and compensating tooling means operatively associated with said turret for die casting a rotor comprising a pair of end tooling members respectively supported by said pressure plates, said turret being rotatable relative to said end tooling members;

means for axially reciprocating said end tooling members relative to said turret;

pin pressing and trimming tooling means operatively associated with said turret for pressing a pin from a die cast rotor and for trimming sprue material from the die cast rotor; and unloading and loading tooling means operatively associated with said turret for loading a rotor lamination stack into said turret;

said casting and compensating tooling, said pin pressing and trimming tooling, and said unloading and loading tooling respectively arranged to substantially simultaneously perform respective operations at said respective locations of said turret in substantially equal amounts of time.

9. The apparatus according to claim 8 wherein said casting and compensating means includes a stationary compensating member for providing full compensation whereby the stack height required for casting a rotor is automatically varied as a function of the die casting requirements of said rotor.

10. The apparatus according to claim 8 wherein one of said end tooling members includes a movable clamping member including an aperture therein and a means for injecting hot molten casting material through said aperture and said movable clamping member.

11. The apparatus according to claim 8 wherein said end tooling members include a movable tooling plate, said apparatus further including a compensating member, said turret, movable tooling plate, and compensating member adapted to cooperate and form a die cavity, said tooling plate adapted to move a distance in the range of three inches to eight inches between its operating and retracted positions.

12. The apparatus according to claim 8 wherein said pin pressing and trimming means includes means for clamping a sprue portion of said rotor and means for moving said rotor a predetermined distance, whereby said sprue portion is severed from said rotor.

13. A method for die casting rotors for electric motors in a die casting apparatus, said die casting apparatus comprising a frame with at least two opposed pressure plates, a rotatable turret including die cavities, end ring tooling carried by each of said die plates and first, second and third stations having a plurality of tooling operatively associated therewith, the turret being operatively mounted between the plates, said method comprising:

compensating for variable rotor stack thickness and casting a first rotor at said first station in a predetermined amount of time;

simultaneously with the compensating and casting operations at said first station, pressing an alignment pin out of a second rotor, and trimming runner material from said second rotor at said second station in substantially said predetermined amount of time;

simultaneously with the compensating and casting operation at said first station, unloading a third rotor from said turret at said third station, and thereafter, loading a stack of laminations into said turret at said third station in substantially said predetermined amount of time;

intermittently rotating the turret relative to the end ring tooling to advance the die cavities from station to station; and maintaining the turret in continuous fixed axial relationship with the pressure plates while maintaining the end ring tooling in fixed circumferential relationship with the pressure plates throughout cycling of the apparatus.

14. The method according to claim 13 wherein said casting operation is accomplished through an aperture in a movable clamping member.

15. The method according to claim 13 wherein said trimming operation includes the steps of clamping a sprue portion of said second rotor and moving said second rotor a predetermined distance within its die cavity in said turret to thereby sever said sprue material and thereafter removing said sprue material.

16. A die casting apparatus for performing a complete die casting operation, said operation including a plurality of functions, said apparatus comprising:

a frame including at least two stationary opposed pressure plates; and a rotating turret member disposed between said two stationary plates in fixed axial relationship therewith, there being operatively associated with said turret member a plurality of stations having tooling means located thereat, for simultaneously performing at least one function of die casting cycle at each said station, said operations to be performed at each said station being selected so that the time required for completion of said operations at each of said plurality of stations is approximately equal;

said plurality of stations comprises three stations and wherein at least one function comprises a pin pressing and trimming means operatively associated with one of said stations, said pin pressing and trimming means including means for clamping a sprue portion of said part to be cast and restraining the sprue portion from movement in the axial direction and means for moving said part after casting a predetermined distance relative to said sprue portion and relative to said stationary turret, whereby said sprue portion may be severed from the cast part, and means for releasing clamping force on said sprue to permit said sprue to drop away.

17. A die casting apparatus for forming rotors for electric motors, said apparatus comprising:

a frame including at least two opposed stationary pressure plates;

a rotating turret operatively mounted between said stationary plates;

a plurality of die cavities in said turret at respective locations circumferentially spaced at regular intervals, said cavities adapted to cooperate with tooling means for forming a rotor;

casting and compensating tooling means operatively associated with said turret for die casting a rotor;

pin pressing and trimming tooling means operatively associated with said turret for pressing a pin from a die cast rotor and for trimming sprue material from a die cast rotor; and unloading and loading tooling means operatively associated with said turret and for loading a rotor lamination stack into said turret;

said casting and compensating tooling, said pin pressing and trimming tooling, and said unloading and loading tooling respectively arranged to substantially simultaneously perform respective operations at said respective locations of said turret in substantially equal amounts of time;

said pin pressing and trimming means including movable means including a clamping means for clamping a sprue to be formed and restraining the sprue from movement in the axial direction, and a rotor moving means for moving said rotor relative to said clamped sprue to sever the sprue from the rotor, said clamping means and rotor moving means being relatively movable.

* * * * *